US006457534B1

(12) United States Patent
Rolovic et al.

(10) Patent No.: US 6,457,534 B1
(45) Date of Patent: Oct. 1, 2002

(54) METHOD OF REDUCING PIPE FATIGUE BY ELIMINATING SHORT MOVEMENTS

(75) Inventors: Radovan Rolovic; David Stein, both of Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/676,189

(22) Filed: Sep. 29, 2000

Related U.S. Application Data

(60) Provisional application No. 60/220,973, filed on Jul. 26, 2000.

(51) Int. Cl.[7] ..... E21B 19/22

(52) U.S. Cl. ..... 166/381; 166/77.2; 242/421.7

(58) Field of Search ..... 166/77.2, 85.5, 166/381, 385; 242/397.2, 403, 417, 418.1, 420.6, 421.6, 421.7

(56) References Cited

U.S. PATENT DOCUMENTS 5,002,130 A 3/1991 Laky ..... 166/351
6,092,756 A 7/2000 Sola ..... 242/399.2
6,142,406 A * 11/2000 Newman ..... 242/390.9
6,273,188 B1 * 8/2001 McCafferty et al. ..... 166/77.2

FOREIGN PATENT DOCUMENTS

WO WO 98/14686 4/1998
WO WO 00/08296 2/2000

OTHER PUBLICATIONS

Coiled Tubing Boat Operation Slides—Schlumberger Technology Corporation (undated).

* cited by examiner

*Primary Examiner*—David Bagnell
*Assistant Examiner*—Jennifer Dougherty
(74) *Attorney, Agent, or Firm*—Robin C. Nava; Wayne I. Kanak

(57) ABSTRACT

This invention relates to a method for use in coiled tubing operations wherein fatigue of the coiled tubing owing to short trips is reduced by reducing the number of bending and straightening events that coiled tubing undergoes to accomplish a particular wellbore objective. The invention relates to a method that allows the coiled tubing reel and tubing reeled thereon to remain stationary while making small movements of coiled tubing using the injector. The invention also relates to a method that permits synchronized movement of coiled tubing between the coiled tubing reel and injector.

13 Claims, 4 Drawing Sheets

METHOD OF REDUCING PIPE FATIGUE BY ELIMINATING SHORT MOVEMENTS

CROSS-REFERENCE TO RELATED APPPLICATIONS

This application claims priority from U.S. Provisional Patent Application No. 60/220,973 filed Jul. 26, 2000.

FIELD OF THE INVENTION

This invention relates to a method for use in coiled tubing operations wherein fatigue of the coiled tubing owing to short trips is reduced.

BACKGROUND OF THE INVENTION

Coiled tubing is increasing in popularity as a method of drilling wells or conducting operations in an oil or gas wellbore. Coiled tubing is used as a continuous strand and is therefore easier and faster than conventional pipe in many applications involving well drilling or well bore operations, such as drilling wells, deploying reeled completions, logging high angle boreholes, and deploying treatment fluids. Coiled tubing is particularly useful in horizontal or multilateral wells.

Conventional coiled tubing operation equipment typically includes coiled tubing spooled on a reel, an injector to run coiled tubing into and out of a well, a gooseneck affixed to the injector to guide the coiled tubing between the injector and the reel, a control cab with the necessary controls and gauges, and a power supply. Additional or auxiliary equipment also may be included.

Typically, the coiled tubing is shipped, stored, and used on the same coiled tubing reel. Coiled tubing reels are deployed from trucks or trailers for land-based wells and from ships or platforms for offshore wells. When spooling or unspooling coiled tubing on a reel, the tubing is subjected to bending forces that can damage it. These bending forces cause tubing fatigue, and this fatigue is a major factor in determining the useful life of a coiled tubing work string.

Various injectors are known to handle various diameters of coiled tubing. A typical gooseneck injector comprises a curved guide member, with the curve extending in an arc of approximately ninety degrees (90°) or more and an injection head comprising a drive motor, drive chain(s), chain tensioners, and a weight indicator. These gooseneck injectors typically include a plurality of rollers for supporting and constraining the tubing while it is being guided along the curved guide member into the injector. The chain tensioners maintain effective traction between the chain and coiled tubing and permit movement of the coiled tubing into and out of the wellbore as controlled by the injector.

Coiled tubing reels typically rely on hydraulic power to operate the reel drive, brake, and spooling guide systems. Most coiled tubing reels can be powered in "in-hole"[i.e. running-in-hole (RIH)] and "out-hole"[i.e. pulling-out-of-hole (POH)] directions. The reel drive and its associated motor provide the reel back-tension, that is the tension in the coiled tubing between the reel and the injector that is used to spool and unspool the tubing on the reel and prevent tubing sagging between the reel and the injector while running coiled tubing into or out of the wellbore. The coiled tubing back-tension can be generated by either the reel or the injector or both. Typically, reel brake systems are self-actuated by an internal spring that requires air or hydraulic pressure to operate the brake release. In conventional operations, the reel brake generally is applied whenever the tubing is stationary. Applying the reel brake prevents the coiled tubing reel from rotating but it does not prevent the coiled tubing on the reel from unwinding owing energy that is stored in the coiled tubing while it is spooled on the reel. Even if the reel brake is applied and the reel is stationary, the coiled tubing can move or unwind if the coiled tubing back-tension is released.

The spooling guide system, commonly known as a levelwind assembly, guides the coiled tubing onto the reel by sensing the motion of the reel and moving the upper free end of the guide arm. Often, some vertical adjustment of levelwind assembly is necessary to achieve the desired angle of the coiled tubing to the reel. The levelwind system has the ability to move left and right (in the general horizontal direction) and up and down (in the general vertical direction). Typically, the vertical movement is controlled manually and the horizontal movement is controlled automatically, with a manual override for small horizontal alignment corrections. It is known to pivot the entire levelwind assembly on the reel support frame to allow the levelwind head to suit the angle at which the tubing leaves the reel.

It is necessary that coiled tubing have sufficient strength to conduct operations downhole without failure or buckling while being flexible enough to be spooled onto a coiled tubing reel. The high section modulus of coiled tubing is advantageous as to its strength and buckling characteristics but is disadvantageous as to its ability to be spooled on a reel. That is, properties that make coiled tubing perform well downhole work to a disadvantage when attempting to spool coiled tubing on the surface of the ground. One such disadvantage of the high section modulus is that high level of energy is stored in the coiled tubing while it is spooled on the reel.

Coiled tubing is subject to strains owing to bending and straightening movements in each coiled tubing operation. The bending and straightening movements lead to fatigue and the coiled tubing must be replaced after a certain number of runs or trips down a well. Furthermore, the strains in coiled tubing may cause residual bends in the tubing which may prevent it from straightening properly in the borehole or rolling properly on the reel.

Coiled tubing passing downward (generally running-in-hole) undergoes at least three straining events: 1) as the coiled tubing is straightened upon leaving the reel and on approach to the gooseneck; 2) as the coiled tubing is curved over the gooseneck; and 3) as the coiled tubing is straightened on its way from the gooseneck to the injector head. Similarly, coiled tubing passing upward (generally pulling-out-of-hole) undergoes at least three straining events: 1) as the coiled tubing is extracted from the wellbore and curved over the gooseneck; 2) as the coiled tubing is straightened upon leaving the gooseneck and on approach to the reel; and 3) as the coiled tubing is being curved onto the reel. These numerous bending and straightening movements strain the coiled tubing and lead to fatigue.

The cost of coiled tubing represents a large expense in coiled tubing drilling and conventional coiled tubing operations. Fatigue is a major factor in determining the useful working life of a coiled tubing work string. Fatigue is a cumulative phenomenon that is not directly measurable and therefore must be predicted in determining useful working life of coiled tubing. Some factors that effect fatigue include number of feet run, bending cycles, bending radii, internal pressure, and material characteristics.

Studies have shown that notable damage to coiled tubing is caused by the fatigue strains that result from the repeated bending and straightening of coiled tubing at the reel, gooseneck, and injector head. Studies of the behavior and fatigue of coiled tubing have shown that the useful life of coiled tubing string is largely determined by fatiguing events outside the wellbore, that is, the coiled tubing handling methods at the surface. In particular, damage is caused by the repeated bending and straightening of the coiled tubing at the gooseneck and reel. What is needed is a system that reduces the fatigue in coiled tubing by reducing the number of bending and straightening events that coiled tubing undergoes to accomplish a particular wellbore objective.

PRIOR ART

WO 98/14686 discloses a tubing reel and a tubing reel injection system that can be tilted about an axis to maintain a desired arch of the tubing between the reel injector and the main surface injector. A forty-five feet (45') arch radius is considered desirable. The arch is maintained throughout the coiled tubing operation, and the tubing is spooled and unspooled from the reel when the tubing is moved in the well.

In the Transocean unit described in U.S. Pat. No. 6,092,756 entitled "Support of a combined feed-outfeed-in device for a coilable tubing", the reel is mounted directly above the injector head. Coiled tubing bending cycles associated with the traditional gooseneck are eliminated but the coiled tubing is still spooled on and unspooled from the reel in the standard manner when the tubing is moved into or out of the well.

Some operations have used a floating vessel to perform coiled tubing operations where the coiled tubing was fixed in another location at the reel. In these applications, the coiled tubing undergoes reverse bending, that is the shape of the pipe profile between the boat and the injector has an "S" configuration. This reverse bending is detrimental because it increases fatigue in the coiled tubing . Furthermore, these operations are not suitable for use on land. During these operations the hold-down rollers on the gooseneck are engaged, the coiled tubing conforms to the gooseneck curvature, and the coiled tubing is subjected to the bending cycles on the gooseneck.

WO 00/08296 relates to tubing injector for moving tubing into and out of a wellbore. The system uses matching sets of engagement assemblies to grip the tubing and produce a lateral latched arrangement around the tubing. The assemblies then move the tubing through the use of a transport mechanism, such as a drive system of chains or sprockets. The injection system is used for continuous tubing, such as coiled tubing or jointed tubing. The tubing is still spooled on and unspooled from the reel every time the tubing is moved in the well.

SUMMARY OF THE INVENTION

The present invention is directed to a system to reduce the fatigue induced by small pipe movements, the system is referred to herein as a short trip module (STM). The system allows the reel to remain stationary while the main injector head moves the tubing. Short trips particularly occur in coiled tubing drilling/milling operations. These small coiled tubing movements create areas of high fatigue in some sections of the coiled tubing. These localized areas of high fatigue prematurely reduce the useable life of the entire coiled tubing string. Existing systems, which only reduce or eliminate bending events at the gooseneck, do not address fatigue induced by spooling and unspooling the tubing from the reel. What is needed is a system to reduce localized fatigue in coiled tubing both at the gooseneck and on the reel, in particular to reduce or eliminate the high localized fatigue induced by short trip movements of coiled tubing.

Initially, at the start of a job or required downhole operation, coiled tubing is run in the wellbore. In accomplishing wellbore operation, often a length of coiled tubing must be pulled out of the wellbore and subsequently run into the wellbore. Frequently the length of coiled tubing involved is short (typically less that 30 feet). These frequent short trips are repetitive and severely fatigue coiled tubing in localized areas.

It is an object of the present invention to provide a system and method to reduce the fatigue in coiled tubing caused by short trips, wherein said system comprises coiled tubing, a coiled tubing reel, a levelwind assembly, a coiled tubing brake, a tubing arch, and a main injector comprising a gooseneck and injector head. The present invention can be used in conjunction with both a conventional reel-gooseneck-injector system and a continuous arch system that includes a reel injector.

In one embodiment, the present invention provides a method to reduce the fatigue induced in coiled tubing by short trips in and out of the well during coiled tubing operations. A conventional reel-gooseneck-injector system is used, comprising a coiled tubing reel, levelwind, power source, injector head, gooseneck, control cab, and monitoring system. In the present invention, the hold-down rollers on the gooseneck of the conventional system are removed to allow the coiled tubing to gradually form an arch radius. Additionally, a coiled tubing brake is installed to regulate or stop the coiled tubing movement on the reel as required by the present invention. This coiled tubing brake is typically mounted on the levelwind and thus called a levelwind brake. The present method comprises: (i) applying the levelwind brake, thereby placing the coiled tubing on the reel in a stationary position during short trips, (ii) pulling the coiled tubing out of the hole or running the tubing in the hole with the main injector head, and (iii) adjusting the levelwind assembly to maintain the coiled tubing in an arch without reverse bending.

The method is used while the coiled tubing is in the wellbore, having been initially run into the wellbore using conventional methods known to those skilled in the art, and when a short trip of the coiled tubing is needed to accomplish a downhole operation. To initiate the short trip module, first a certain short length of coiled tubing must be pulled out of the wellbore by using the injector head without spooling the tubing on the reel. When pulling coiled tubing out of the wellbore, the method comprises applying the braking force of the levelwind brake to stop the coiled tubing reel from turning and prevent the coiled tubing on the reel from moving, while forming a tubing arch between the reel and injector head. The tubing arch does not exceed the maximum arch height in which the arch becomes unstable or interferes with surface equipment. The maximum arch height relates to the stability of the arch and depends on the equipment geometry, the coiled tubing dimensions, and environmental factors such as wind speed. If the maximum allowed arch height is exceeded, the levelwind brake is gradually released to allow the tubing to be spooled on the reel and continue pulling out of hole using normal spooling procedures.

When running coiled tubing into the wellbore during the short trip mode of operation, the tubing between the reel and the gooseneck is already in an arch form. The method then comprises activating the levelwind brake, adjusting the levelwind arm to maintain the coiled tubing in a gradually decreasing arch between the reel and the injector head; slowing the speed of the coiled tubing in the injector prior to contacting the gooseneck with the tubing; gradually releasing the levelwind brake; contacting the gooseneck with the coiled tubing; releasing the levelwind brake and adjusting the reel back tension to normal operating conditions; and continue running in hole using normal spooling procedures.

In another embodiment, the present invention further provides an automated system for controlling the various components and managing a tubing arch during the short trip mode of operation comprising a control system, a height sensor, monitors and relays of levelwind brake pressure, reel depth, reel back pressure, and a load cell.

In another embodiment, the present invention is used in conjunction with a continuous arch system, said system comprising a reel traction device. The method comprises (i) applying the reel traction device as a brake, thereby placing the coiled tubing on the reel and the coiled tubing reel in a stationary position; (ii) pulling the coiled tubing out of the hole and running the coiled tubing in the hole with the main injector head; and (iii) adjusting the levelwind assembly to maintain the coiled tubing in an arch form without reverse bending. The present invention may further comprise a reel traction control system to automate the application of the reel traction device.

These and other objects, advantages, features and aspects of the present invention will become apparent as the following description proceeds. The following description and the drawings setting forth detail certain illustrative embodiments of the invention, these being representative, however, of but several of the various ways in which the principles of the invention may be employed.

DETAILED DESCRIPTION

Figure 1:
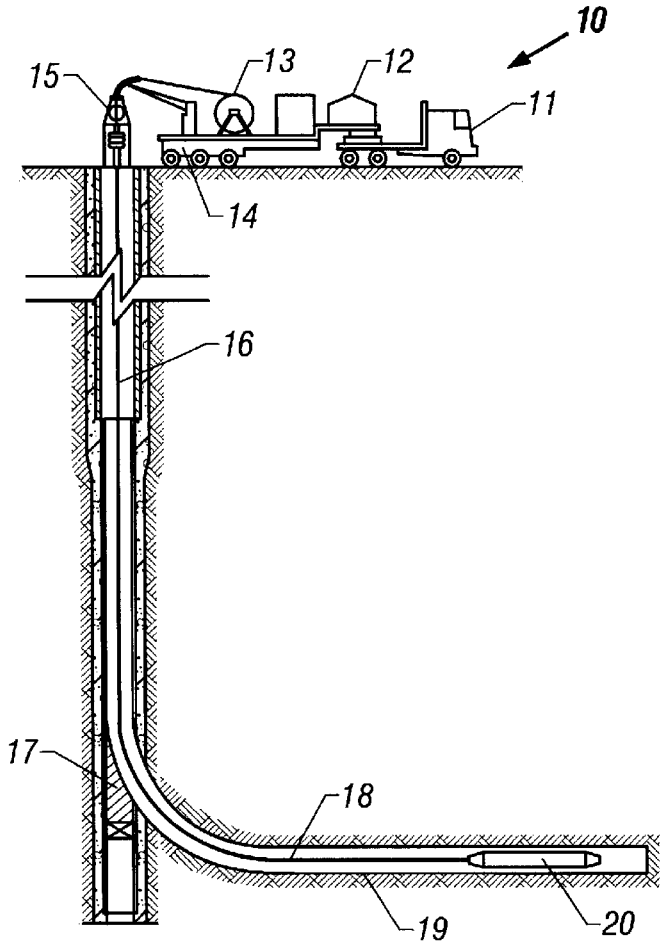
FIG. 1 (Prior Art)
FIG. 1 shows the coiled tubing operating environment of this invention.

In FIG. 1, the operating environment of this invention is shown. Coiled tubing operation 10 comprises of a truck 11 and/or trailer 14 that supports power supply 12 and tubing reel 13. While an on-land operation is shown, the method or device according to the present invention is equally well suited for use in drilling for oil and gas as well and other coiled tubing operations both on land and offshore. Such trucks or trailers for coiled tubing operations are known. One such trailer is described in U.S. patent application Ser. No. 09/454,465, entitled Trailer mounted coiled tubing rig, incorporated herein in its entirety by reference.

An injector head unit 15 feeds and directs coiled tubing 16 from the tubing reel into the subterranean formation. The configuration of FIG. 1 shows a horizontal wellbore configuration which supports a coiled tubing trajectory 18 into a horizontal wellbore 19. This invention is not limited to a horizontal wellbore configuration. Downhole tool 20 is connected to the coiled tubing, as for example, to conduct flow or measurements, or perhaps to provide diverting fluids.

Figure 2:
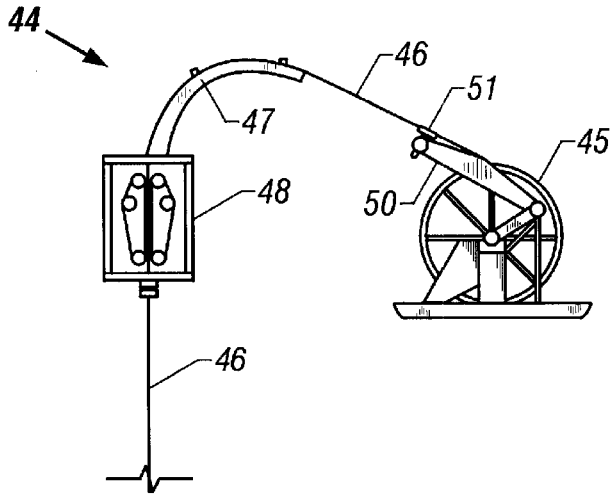
FIG. 2 (Prior Art)
FIG. 2 represents a coiled tubing unit having a hydraulically operated tubing reel and shows the bending events that coiled tubing undergoes while moving from the coiled tubing reel to the main injector.

The forces and strains placed upon coiled tubing when it is used in a coiled tubing unit 44 are apparent from viewing FIG. 2. Coiled tubing undergoes numerous bending events each time it is run into and out of a wellbore. The tubing is plastically deformed on the reel. Coiled tubing 46 is straightened when it emerges from the coiled tubing reel 45. Coiled tubing 46 is guided from the reel by way of levelwind assembly 50. Levelwind assemblies are known those skilled in the art. One such levelwind assembly is described in U.S. patent application Ser. No. 09/409,113, entitled Apparatus and process for coiled tubing systems, incorporated herein in its entirety by reference. Coiled tubing brake 51 on the levelwind assembly 50 is shown. The coiled tubing is bent as it passes over the gooseneck 47, and is straightened as it goes into the injector head 48 for entry into the wellbore. Of course, each bending event is repeated in reverse when the tubing is later extracted from the wellbore.

These bending events weaken the tubing each time it is used, and tubing use must be monitored. Tubing is discarded when it has been used beyond an acceptable safety limit as indicated by reaching predicted fatigue limits. The coiled tubing, typically made of steel, is plastically deformed every time it is spooled off the reel, bent over the gooseneck, straightened through the chains, and in the reverse process. It is known that the fatigue resistance of steel is severely degraded when it is plastically deformed. In addition to the number of bending events or trips in and out of a wellbore, bending radius is an important factor, with smaller radii inducing greater fatigue. Furthermore, higher fatigue is induced when coiled tubing is subjected to reverse bending.

The present invention relates to a system that allows the coiled tubing reel 45 and the coiled tubing on the reel to remain stationary while the tubing is making small movements in the injector and in the well, typically 30 feet or less. The present invention is useful when the coiled tubing 46 is repeatedly pulled out of the hole and run in the hole for short lengths (small movements), while the maximum tubing depth in the hole after each back-and-forth tubing movement is changed by less than the length of tubing that was previously stored in the coiled tubing arch or not changed at all.

The present invention is implemented after coiled tubing has been run in the wellbore. Methods to run coiled tubing into a wellbore are known to those skilled in art. When pulling coiled tubing out of the wellbore for a short trip, the levelwind brake of the present invention is activated, such that the coiled tubing forms an arch between the reel and the injector head. If a sufficient length of coiled tubing is pulled out of the hole such that the arch reaches the activation height, the levelwind brake is gradually released, permitting movement of the coiled tubing reel, and allowing spooling of the excess length of coiled tubing onto the reel. When it is necessary to run a length of coiled tubing into the wellbore to accomplish a downhole operation, the injector head moves the coiled tubing into the wellbore, thereby decreasing the arch height. If additional lengths of coiled tubing are needed beyond that pulled out of the wellbore during the initial stage of the short trip, the brake is gradually released to permit the coiled tubing reel to move and unspool additional coiled tubing.

Figure 3:
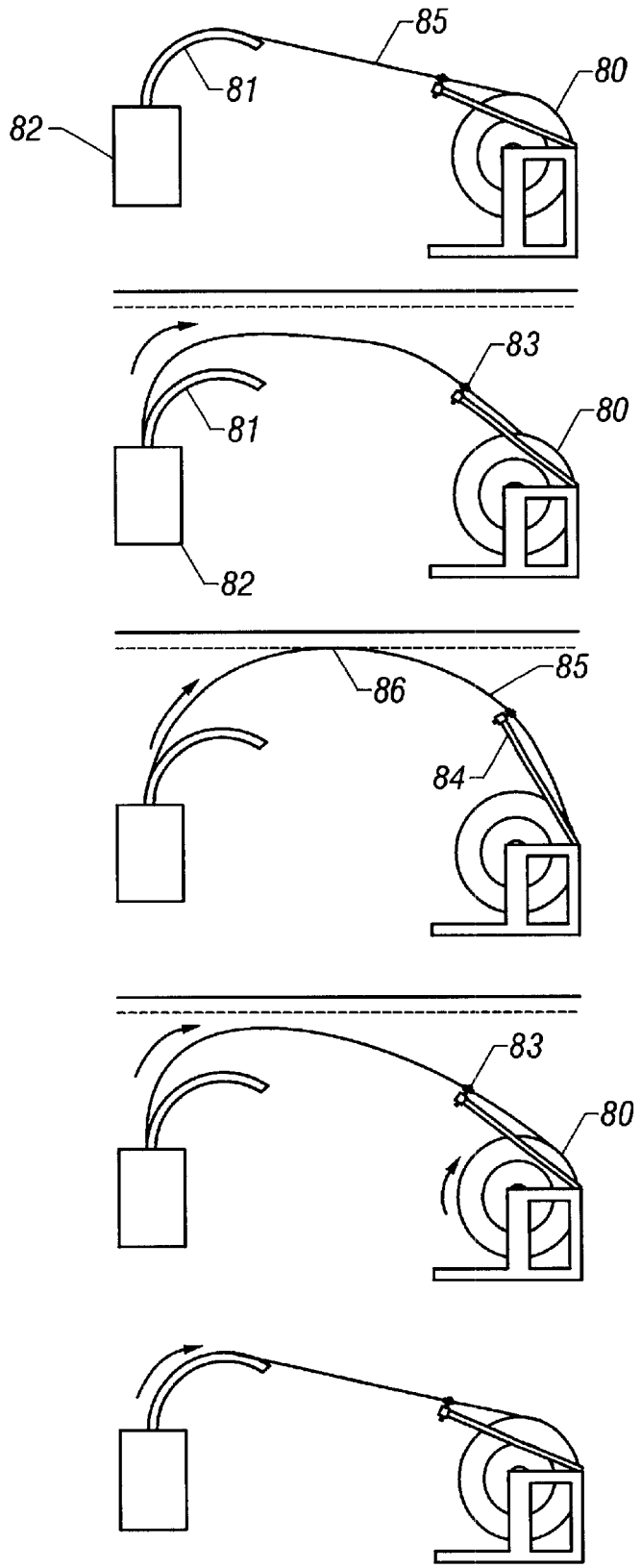
FIG. 3 represents the initiation and the operation of the short trip module when pulling out of hole.

FIG. 3 represents the initiation phase of operation of the present invention as well as the operation of the present invention as coiled tubing is pulled-out-of-hole, that is, generally passing in an upward direction. In this configuration, coiled tubing 85 already extends from the reel 80 over the gooseneck 81 through the injector head 82 and into the wellbore to the required working depth. Methods of achieving this common coiled tubing configuration are known to those skilled in the art. It is understood in running in-hole drilling or operations, that short lengths of the coiled tubing work string are frequently extracted from the wellbore to accomplish downhole operations such as drilling formation, engaging or disengaging a bottom hole apparatus, fishing for a tool, re-entering a multi-lateral well, or a variety of other downhole operations.

In one embodiment of the present invention, when pulling-out-of-hole is required to extract a short length (typically 30 feet or less) of the coiled tubing from the wellbore to accomplish drilling or operations, levelwind brake 83 is activated and backpressure of the reel 80 is reduced. With levelwind brake 83 activated, reel 80 and the coiled tubing on the reel are stationary. Coiled tubing extracted from the wellbore by the injector head 82, after being in the initial contact with gooseneck 81, forms an arch of coiled tubing having increased height. As reel 80 and reeled coiled tubing are kept stationary with levelwind brake 83 activated, injector head 82 moves the coiled tubing out of and into the wellbore. Levelwind assembly 84 is adjusted to maintain a smooth arch profile and to avoid reverse bending in the coiled tubing 85. The height of the coiled tubing arch 86 is monitored and as the coiled tubing reaches the activation height, which is the maximum allowed height of coiled tubing, the levelwind brake 83 is gradually released to allow the reel 80 to rotate, thereby permitting spooling of coiled tubing 85 on reel 80.

This spooling can be used to lower the height of the coiled tubing arch 86 by permitting the length of coiled tubing extracted from the wellbore to be spooled on the reel 80. When, after an interval of spooling, the height of the coiled tubing arch 86 is lowered sufficiently or the coiled tubing 85 again contacts the gooseneck, the method of the present invention can be repeated, if desired. That is, reel 80 and the coiled tubing on the reel can be made stationary by applying levelwind brake 83. A length of coiled tubing can be extracted from the wellbore using the injector head 82. This length of coiled tubing 85 is permitted to form an arch with a height less than or equal to the activation height. Upon reaching the activation height, the brake 83 is gradually released and the excess coiled tubing is permitted to spool on reel 80.

Alternatively, the levelwind brake 83 can be adjusted to synchronize the speed of rotation of the coiled tubing reel 80 with the speed of the injector head 82, thereby maintaining the arch between the coiled tubing reel 80 and the injector head, while permitting the coiled tubing to be spooled on the reel 80. This alternate method reduces the three fatigue events induced from the prior art to only one event, that of spooling the coiled tubing on the reel 80.

This embodiment of the present invention permits short trips of coiled tubing into and out of the wellbore without spooling the tubing on the reel 80. That is, by accommodating short lengths of coiled tubing within the coiled tubing arch while maintaining the reel and the coiled tubing on the reel in a stationary position by activating the brake, the number of fatigue inducing spooling and unspooling events is reduced.

Using prior art methods, without the benefit of the present invention, these short lengths of coiled tubing would be extracted from the wellbore through the injector head 82 and over the gooseneck 81 and spooled directly onto the reel 80 as guided by the levelwind assembly 84, using the reeling motion of the coiled tubing reel 80. Whenever it was necessary in drilling or operations to reinsert a length of coiled tubing into the wellbore, conventional practice required that the length be unspooled from the reel 80 guided by the levelwind assembly 84 to the gooseneck 81, extended over the gooseneck 81, through the injector head 82 and into the wellbore. Thus, for each required short trip in prior art, the coiled tubing undergoes at least two fatigue cycles as it is spooled and unspooled on the reel. The present invention eliminates these spooling related fatigue cycles by maintaining the coiled tubing on the reel and the reel 80 stationary, which is achieved by applying levelwind brake 83, permitting the injector head 82 to move the coiled tubing into and out of the wellbore on short trips, and by accommodating within the tubing arch those lengths of coiled tubing required to be extracted from or be inserted into the wellbore.

Figure 4:
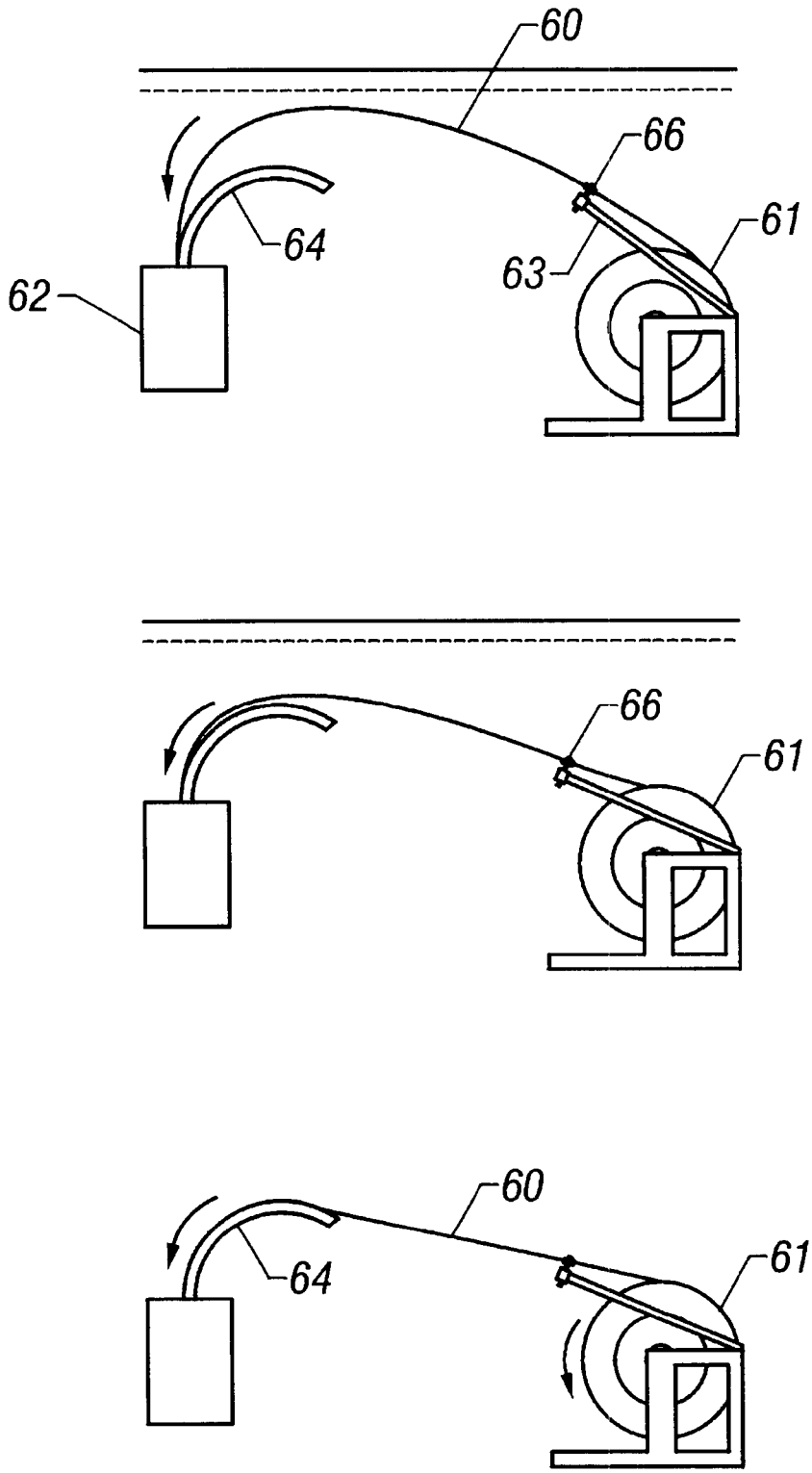
FIG. 4 represents the operation of the short trip module when running in the hole.

FIG. 4 represents the operation of the present invention as coiled tubing is being run-in-hole during the short trip mode of operation, that is, generally passing in a downward direction. A continuous arch of coiled tubing has already been formed between the reel and the injector head during the initial, pulling-out-of-hole part of short trip mode of operation. It is understood in pulling-out-of-hole drilling or operations, that short lengths of coiled tubing are frequently further extended into the wellbore to accomplish downhole operations such as drilling formation, engaging or disengaging a bottom hole apparatus, fishing for a tool, re-entering a multi-lateral well, or a variety of other downhole operations.

In one embodiment of the present invention, when the coiled tubing 60 already forms an arch between the reel 61 and the injector 62, running-in-hole is required to extend a short length (typically 30 feet or less) of the coiled tubing into the wellbore to accomplish drilling or operations. With levelwind brake 66 activated, reel 61 and coiled tubing on the reel are stationary and an arch of coiled tubing is present between the reel 61 and the injector head 62. Coiled tubing is extended into the wellbore through the movement of the injector head 62. As coiled tubing is passed into the wellbore, the height of the arch decreases. The levelwind assembly 63 is used and can be adjusted to maintain a smooth arch profile between the reel 61 and the injector head 62. In the present invention, the length of coiled tubing to be extended into the wellbore is typically accommodated within the arch of coiled tubing and is not unspooled from reel 61. If additional lengths of coiled tubing are needed, such as when the coiled tubing is about to contact the gooseneck 64, the brake 66 can be gradually released to permit the coiled tubing to be unwound from the reel 61. This method reduces the number of straining events effecting the coiled tubing by eliminating the need to spool the coiled tubing and subsequently unspool the coiled tubing for short trips. Reducing the number and frequency of these straining events reduces the rate at which the coiled tubing is fatigued and extends the useful life the coiled tubing work string.

For example, a comparison of coiled tubing fatigue was made using the prior art methods and the present invention. The comparison was made by calculating the effect of the short trip module (STM) on data compiled from field jobs conducted using prior art methods. In these calculations, the STM was used for short trips of 30 feet or less. In comparing two (2) complete well drilling operations, consisting of 29 runs (from surface to maximum depth and back to surface), it was determined that fatigue caused by use of the prior art methods for short trips consumed about 21% of the useful life to the coiled tubing work string. That is, the useful life of the coiled tubing work string was reduced by about 21% owing to the fatigue strains generated by short trips using the prior art methodology. In comparison, the fatigue strains generated by short trips when using the present invention reduced the useful life of the coiled tubing work string by less than 10%. This comparison can be interpreted as indicating that the consumption of useful life of coiled tubing by fatigue resulting from short trips can be reduced by more than half through the use of the STM.

Figure 5:
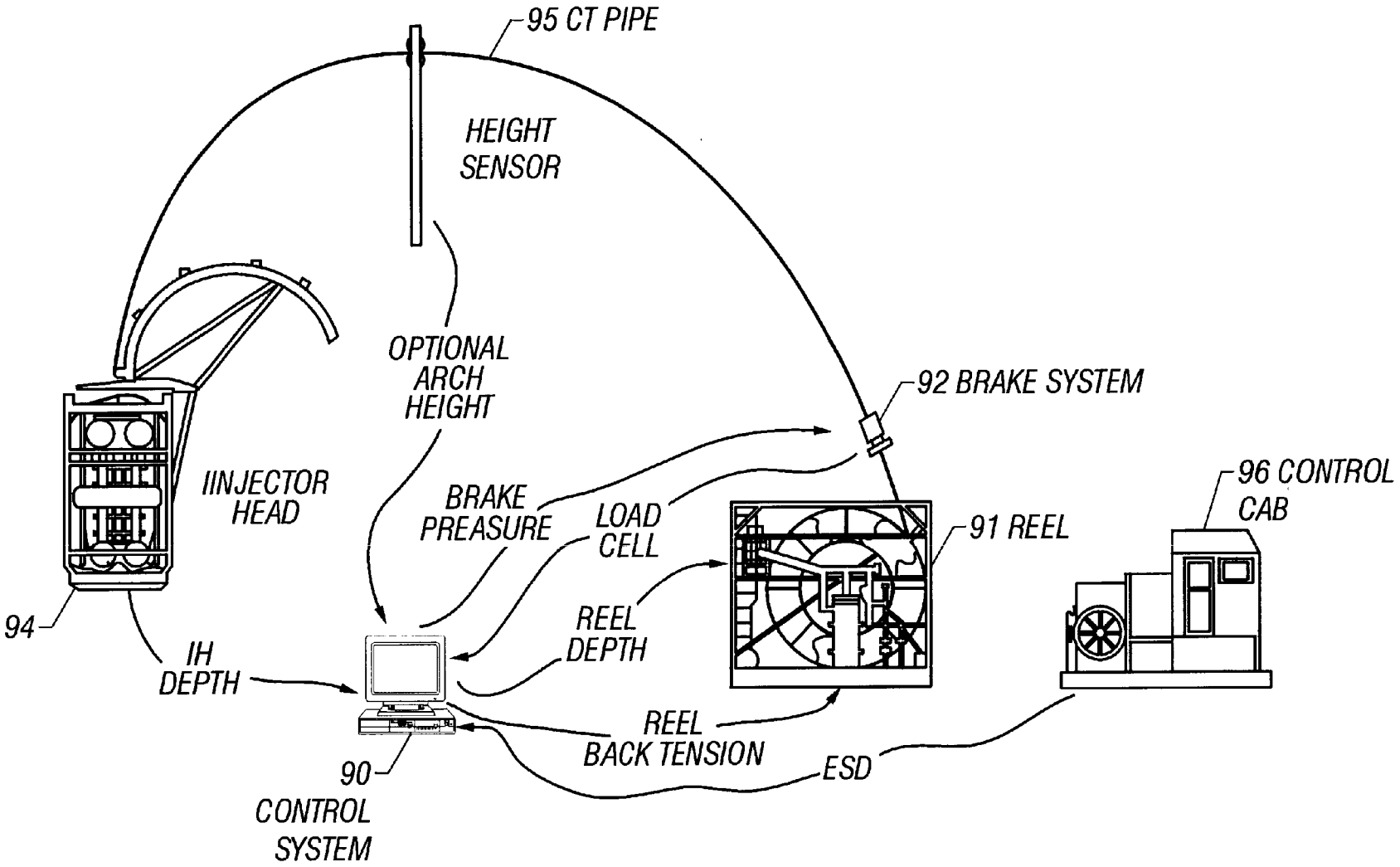
FIG. 5 represents the short trip module with associated automated control system.

FIG. 5 represents the present invention comprising a system for operating and monitoring the short trip module. A control system 90, comprising means for receiving, recording, and comparing data in a microprocessor, receives input and data from sensors and devices that monitor the coiled tubing reel 91, the brake 92, the levelwind assembly, the injector head 94, and optionally the arch height 95 or the reel depth monitor. The control system 90 receives, records, and compares the input and data from these sensors. The control system 90 relays this information to the control cab 96, wherein the various components can be adjusted as required either automatically or manually. In this manner, the brake 92 can be activated or released as necessary in response to the height of the tubing arch, thereby preventing or permitting spooling or unspooling of coiled tubing from the reel 91.

What is claimed is:

1. A method for reducing fatigue in coiled tubing comprising coiled tubing, a coiled tubing reel, a coiled tubing brake, a gooseneck, and an injector head, wherein the coiled tubing reel is maintained in a stationary position and the injector head is permitted to move the coiled tubing in and out of a well.

2. The method of claim 1, wherein said method is automated, further comprising a control system.

3. The method of claim 2 wherein said automated method further comprises an arch height sensor.

4. A method of conducting wellbore operations comprising coiled tubing, a coiled tubing reel, a coiled tubing brake, a gooseneck, and an injector head, wherein the coiled tubing reel is maintained in a stationary position and the injector head moves the coiled tubing into and out of the wellbore for short trips.

5. The method of claim 4, wherein said coiled tubing is being extracted from a wellbore.

6. The method of claim 4, wherein said coiled tubing is being extended into a wellbore.

7. The method of claim 4, wherein said method is used in coiled tubing drilling.

8. The method of claim 4, wherein said method is used in reentry of multilateral wells.

9. The method of claim 4, wherein said method is automated, further comprising a control system.

10. The method of claim 9 wherein said automated method further comprises an arch height sensor.

11. A method of conducting wellbore operations comprising a continuous arch of coiled tubing, a coiled tubing reel, a reel traction device, and an injector, wherein the reel traction device is engaged and maintains the coiled tubing reel in a stationary position.

12. The method of claim 11, wherein said method is automated, further comprising a control system.

13. The method of claim 12 wherein said automated method further comprises an arch height sensor.

* * * * *